United States Patent [19]

Helms

[11] Patent Number: 4,991,999

[45] Date of Patent: Feb. 12, 1991

[54] CORRUGATED STRUCTURAL PANELS

[76] Inventor: Robert C. Helms, 2470 S. Dairy Ashford #200, Houston, Tex. 77077

[21] Appl. No.: 519,944

[22] Filed: May 7, 1990

[51] Int. Cl.[5] ..... E21D 11/00

[52] U.S. Cl. ..... 405/151; 405/133; 405/153; 405/272

[58] Field of Search ..... 405/124, 126, 133, 151, 405/152, 153, 272, 284; 52/81, 82, 245, 578, 582

[56] References Cited

U.S. PATENT DOCUMENTS

| | | | |
|---|---|---|---|
| 1,049,543 | 1/1913 | Smith | 405/124 X |
| 1,535,162 | 4/1925 | Kime | 405/124 X |
| 2,820,349 | 1/1958 | Cooper | 405/273 |
| 3,601,995 | 8/1971 | Herrsching et al. | 405/153 X |
| 3,996,752 | 12/1976 | Oger | 405/151 |
| 4,068,482 | 1/1978 | Hilfiker | 405/272 |
| 4,199,278 | 4/1980 | Koehl | 405/282 |
| 4,259,029 | 3/1981 | Koehl | 405/282 |
| 4,312,606 | 1/1982 | Sarikelle | 405/286 |
| 4,319,791 | 3/1982 | Gibson | 312/239 |
| 4,376,599 | 3/1983 | Krings | 405/282 |
| 4,685,837 | 8/1987 | Cicanese | 405/282 |
| 4,693,634 | 9/1987 | Chiaves | 405/126 |

FOREIGN PATENT DOCUMENTS

| | | | |
|---|---|---|---|
| 713890 | 11/1941 | Fed. Rep. of Germany | 405/282 |
| 94582 | 6/1983 | Japan | 405/282 |

*Primary Examiner*—David H. Corbin

*Attorney, Agent, or Firm*—Larry Mason Lee

[57] ABSTRACT

An improvement in corrugated structural panels, useful in the construction of tunnels, shoring, and other pressure bearing or containing structures, wherein the improvement comprises the utilization of a prism element transverse to the longitudinal axis of the corrugation in the design of the end sections of each corrugation within the panel thereby providing means to collect shear, bending and axial stresses from the corrugated panel and transmit them to the panel's supporting edge.

4 Claims, 2 Drawing Sheets

CORRUGATED STRUCTURAL PANELS

SUMMARY OF THE INVENTION a. Field of Invention

The present invention relates to the field of structural panels useful in the construction of pressure bearing or containing tunnels, shafts, shoring and retaining walls.

More particularly, the present invention relates to corrugated structural panels useful in the construction of pressure bearing or containing tunnels, shoring and retaining walls.

Yet more particularly, the present invention relates to corrugated structural panels constructed of fiber reinforced plastic, which panels are useful in the construction of pressure bearing or containing tunnels, shoring and retaining walls.

b. Background of the Invention

A substantial need exists for lightweight, strong (structurally efficient) structural panels which may be used in the construction of pressure bearing or containing tunnels, shoring and walls.

An additional need exists for such above-described structural panels which may be stored compactly when not in use.

A further need exists for structural panels which fulfill the above-described needs and, further, are nonmetallic.

Accordingly, it is a primary object of this invention to provide a structural panel suitable for use in construction of pressure bearing or containing tunnels, shoring, and retaining walls.

It is another object of this invention to provide a structural panel which is lightweight and strong (having a high structural efficiency) and may be used in the construction of pressure bearing or containing tunnels, shoring and retaining walls.

It is yet another object of this invention to provide a structural panel which fulfills the above-stated objects and is, further, designed such that a plurality of said structural panels may be compactly stored when not in use.

It is a further and final object of this invention to provide a structural panel which fulfills all of the above-stated objects and is, further, itself constructed of nonmetallic materials.

DESCRIPTION OF PREFERRED EMBODIMENT

Figure 1:
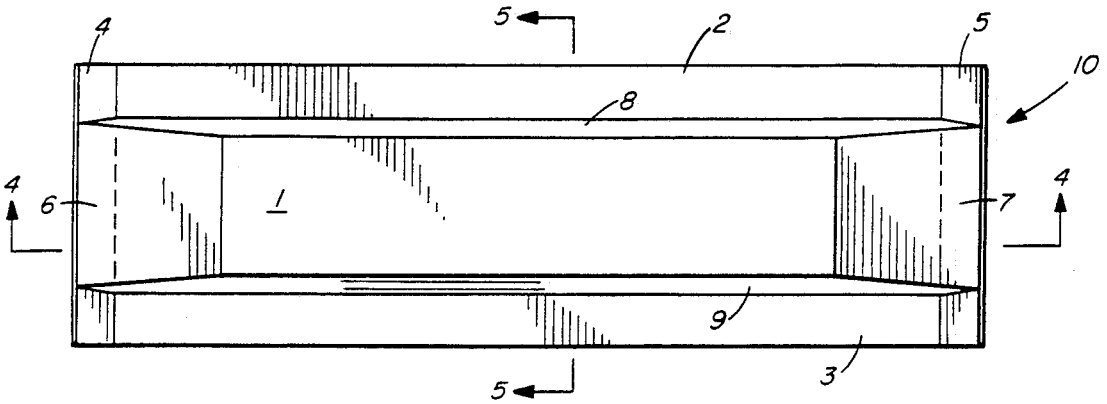
FIG. 1 is a vertical elevation of a singly corrugated version of the invention.
Figure 2:
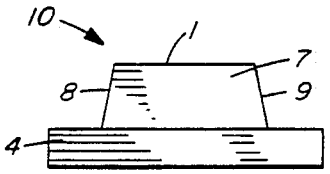
FIG. 2 is an end view of a singly corrugated version of the invention.
Figure 7:
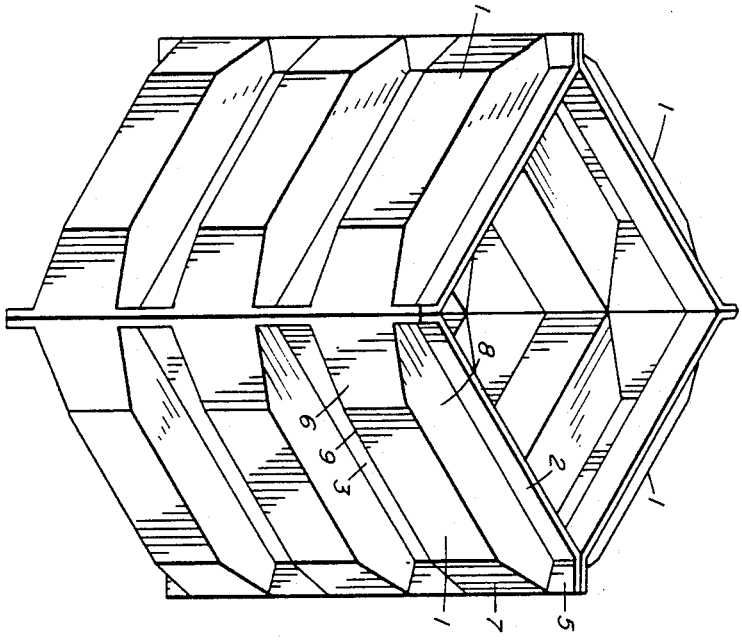
FIG. 7 is a perspective view of a tunnel segment constructed of closed polygonals formed by connection of multi-corrugated panels comprising the invention.
Figure 6:
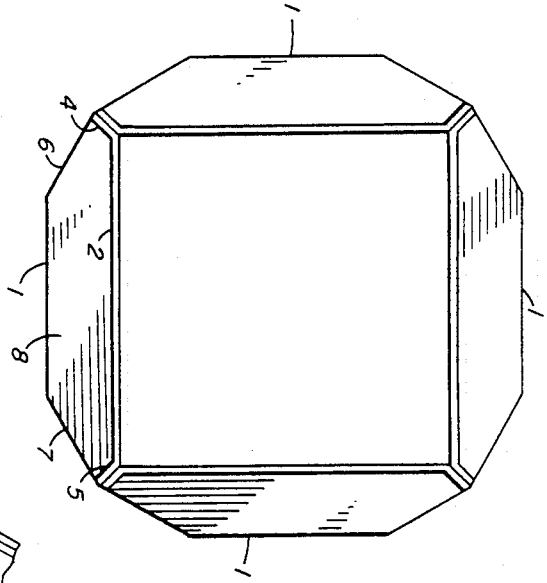
FIG. 6 is an end view of a closed polygon constructed by connection of four of the panels comprising the invention.

As seen in FIG. 1, the instant invention is a structural panel (10) which is corrugated. The corrugation form used is that of the folded plate type. The structural panel (10) shown in FIGS. 1 through 5 has, for simplicity, but a single corrugation while in practice, a multiplicity of corrugations may be constructed into a single structural panel (10) as seen in FIG. 7.

A structural panel (10) having a single corrugation, as in FIGS. 1 through 5, will be described because the unique design of the singly corrugated panel is simply repeated for construction of a structural panel (10) having multiple corrugations.

The elements of a singly corrugated structural panel (10) are an outer flange (1), inner flanges (2 and 3), webs (8 and 9), triangular prisms (6 and 7), and bearing flanges (4 and 5).

Figure 5:
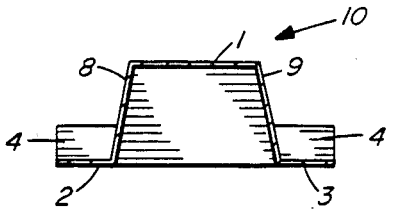
FIG. 5 is a sectional view of a singly corrugated version of the invention taken along the line 5—5.
Figure 3:
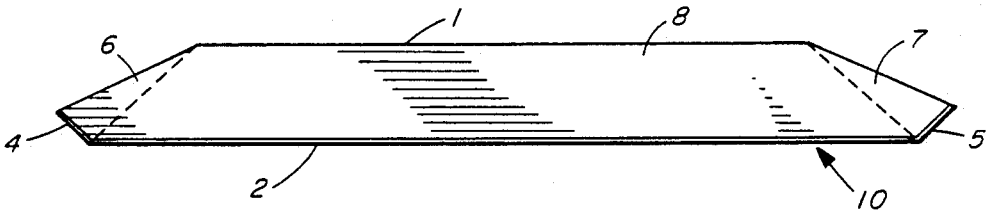
FIG. 3. is a lateral view of a singly corrugated version of the invention.
Figure 4:
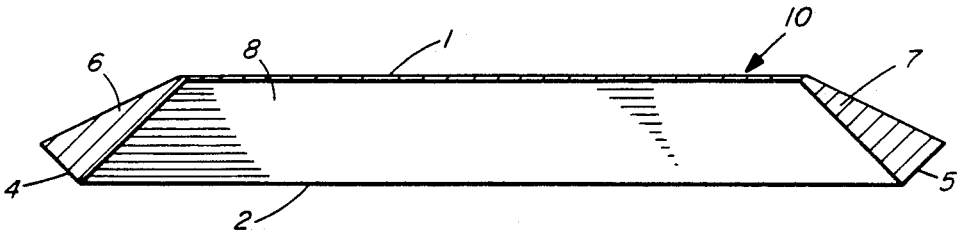
FIG. 4 is a sectional view of a singly corrugated version of the invention taken along the line 4—4.

The shape of a single corrugation of a structural panel (10) is clearly shown in FIG. 5 wherein the ridge of such corrugation is the outer flange (1), the grooves or bottom folds of the corrugation are the inner flanges (2 and 3), and the walls of the corrugation are the webs (8 and 9).

Each corrugation within the structural panel (10) of the instant invention is, however, ended in a unique fashion. The end of each corrugation is connected, perhaps integrally, to a triangular prism (6 or 7) element referred to herein as a triangular prism (6 or 7). The external shape, but not necessarily the internal construction, of said triangular prism (6 or 7) element is that of a solid formed by linearly connecting all points between two triangles coplanar with the webs (8 and 9). The triangular prism (6 or 7) element is located at the end of each corrugation within the structural panel (10) transversely to the longitudinal axis of the corrugation. Said triangular prism (6 or 7) serves to transmit the forces from the corrugation to the bearing flange (4 or 5). Both bending and axial forces are transmitted by the triangular prism (6 or 7) to the bearing flange (4 or 5) from the corrugation.

The bearing flange (4 or 5) is integral to one of the three faces of the triangular prism (6 or 7, respectively). One edge of each bearing flange (4 or 5) is connected to the inner flanges (2 and 3). The bearing flanges (4 and 5) form the supporting edges of the structural panel (10) and each bearing flange (4 or 5) lies in a plane inclined to the longitudinal axis of the structural panel (10) thereby providing a bearing surface which in the preferred embodiment is normal, but need not be, to the vector resultant of the summation of the reactive forces.

The two inner flanges (2 and 3) are coplanar and they have parallel longitudinal axis. The outer flange (1) is in a plane parallel to the two inner flanges (2 and 3) and has a longitudinal axis parallel to the longitudinal axis of the inner flanges (2 and 3).

The two triangular prisms (6 and 7) are parallel to one another, but transverse to the longitudinal axis of the outer flange (1) and thus to the longitudinal axis of the corrugation. The two bearing flanges (4 and 5) have their long axes parallel to one another and to the axes of the triangular prisms (6 and 7). The long axes of the two bearing flanges (4 and 5) are perpendicular to the longitudinal axes of the inner flanges (2 and 3), to the longitudinal axis of the outer flange (1), and to the longitudinal axes of the webs (8 and 9).

The webs (8 and 9) serve to connect the long edges of the outer flange (1) to the long edges of the inner flanges (2 and 3) and serve, additionally, to carry shear loads perpendicular to the longitudinal axis of the corrugation. The webs (8 and 9) are non-parallel in the preferred embodiment and angle inwardly from the long edges of the inner flanges (2 and 3) to the long edges of the outer flange (1) toward one another.

In the preferred embodiment, the structural panel (10) is constructed of fiber reinforced plastic which provides a lightweight material which may be fiber reinforced at various points or locations throughout the structural panel (10) to provide needed strength and force bearing characteristics for particular applications. However, the design of the instant structural panel (10) is such that it may be usefully constructed of various other metallic and non-metallic materials.

The corrugated shape of the structural panel (10) is, in the preferred embodiment, such that multiple panels may be stacked by laying each panel flat upon the preceding panel and aligning the corrugations of each succeeding panel to overlay the corrugations of the preceding panel.

The design of the corrugation of the structural panel (10) provides for certain specific desirable characteristics. The outer flange (1) in combination with the inner flanges (2 and 3) provides high resistance to bending moments induced by loading that is perpendicular to the longitudinal axis of the corrugation. Bending moments created by forces acting normal to and inwardly upon the plane of the outer flange (1) are resisted by compressive forces induced in the outer flange (1) and tensile forces induced in the two inner flanges (2 and 3). Reversed bending moments are resisted by tensile forces induced in the outer flange (1) and compressive forces induced in the inner flanges (2 and 3).

The unique design of the corrugation end sections provides certain additional desirable characteristics. Each corrugation end section comprises a triangular prism element (6 or 7), which is transverse to the longitudinal axis of the corrugation. The triangular prism element (6 or 7) efficiently collects stresses (compression, tension and shear) from the flanges and webs of the corrugation and transmits said stresses to the bearing flange (4 or 5) outwardly facing surface which comprises the load bearing edge of the structural panel (10).

Figure 8:
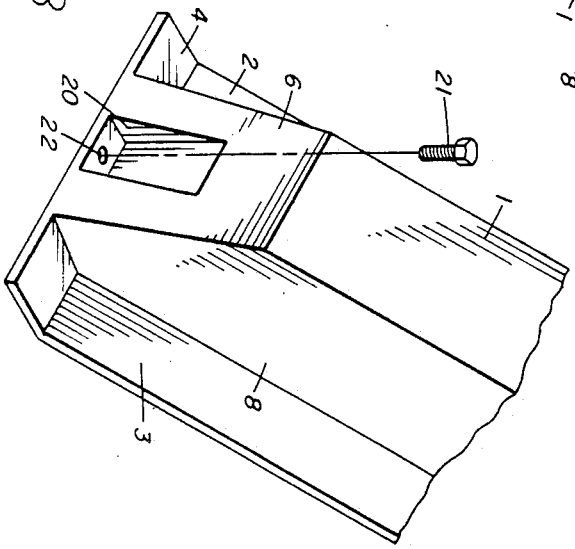
FIG. 8 is a perspective view of one end of a single corrugation providing a fastener pocket or void.

As shown in FIG. 8, one or more fastener pockets or voids (20) may exist within the triangular prism element (6 or 7) to accommodate fastener (21) ends. Said fastener pocket or void (20) within the triangular prism element (6 or 7) may be open to anyone or more or none of the triangular prism element (6 or 7) faces adjacent to the triangular prism element (6 or 7) face which is integral to the bearing flange (4 or 5). An aperture (22) through the bearing flange (4 or 5) allows a fastener (21) shaft to protrude from the fastener pocket or void (20) internal to the triangular prism to a supporting connection outside the structural panel (10). Likewise said supporting connection may comprise an aperture (22) in the bearing flange (4 or 5) of an adjacent structural panel (10) which provides fastener pockets or voids (20) to accommodate fastener (21) ends.

This invention has been described in terms of single preferred embodiment, however numerous embodiments are possible without departing from the essential characteristics thereof. Accordingly, the description has been illustrative and not restrictive as the scope of the invention is defined by the appended claims, not by the description preceding them, and all changes and modifications that fall within the stated claims or form their functional equivalents are intended to be embraced by the claims.

What is claimed is:

1. A corrugated structural panel wherein:
   said corrugation is of the folded plate type;
   each of said corrugations comprises an outer flange, two inner flanges, and two webs;
   the said outer flange is in a plane parallel to the plane containing said two inner flanges;
   the longitudinal axis of said outer flange is parallel to the longitudinal axis of each of said two inner flanges;
   each long edge of said outer flange is connected by a web to one long edge of one of said inner flanges;
   said corrugation is terminated on each end by a triangular prism element located transversely to the longitudinal axis of the corrugation; and
   said triangular prism element is externally shaped as a solid, triangular in cross-section; and
   one face of said triangular prism element serves as an edge of said corrugated structural panel and as a bearing plate to transmit forces from the structural panel to the structural panel's connecting support.

2. The corrugated structural panel of claim 1 wherein:
   said triangular prism piece is constructed of angles such that said bearing plate has one outwardly facing surface which is normal to the vector resultant from addition of axial and normal forces on the edge of said structural panel.

3. The corrugated structural panel of claim 1 wherein:
   said triangular prism element contains one or more voids.

4. The corrugated structural panel of claim 1 wherein:
   said corrugated structural panel is constructed of fiber reinforced plastic.

* * * * *